United States Patent [19]

Fuller et al.

[11] Patent Number: 4,889,283

[45] Date of Patent: Dec. 26, 1989

[54] APPARATUS AND METHOD FOR STREAM DIVERTER

[75] Inventors: Mark Fuller, Studio City; Alan S. Robinson, El Monte, both of Calif.

[73] Assignee: Wet Enterprises, Inc., Universal City, Calif.

[21] Appl. No.: 235,798

[22] Filed: Aug. 22, 1988

Related U.S. Application Data

[63] Continuation of Ser. No. 96,315, Sep. 9, 1987, abandoned, which is a continuation of Ser. No. 800,223, Nov. 25, 1985, abandoned.

[51] Int. Cl.[4] ..... B05B 17/04; B05B 17/08

[52] U.S. Cl. ..... 239/11; 239/17; 239/124; 239/569; 239/590.5

[58] Field of Search ..... 239/11, 12, 17–23, 239/99, 101, 124, 543, 569, 590.5

[56] References Cited

U.S. PATENT DOCUMENTS

| | | | |
|---|---|---|---|
| 3,151,811 | 10/1964 | Hruby, Jr. | 239/17 |
| 3,801,010 | 4/1974 | Hruby, Jr. | 239/590.5 |
| 3,930,616 | 1/1976 | Winter | 239/569 |
| 4,416,420 | 11/1983 | Thompson | 239/22 |

*Primary Examiner*—Andres Kashnikow
*Assistant Examiner*—Michael J. Forman
*Attorney, Agent, or Firm*—Blakely, Sokoloff, Taylor & Zafman

[57] ABSTRACT

The present invention provides a means for generating and controllably terminating a laminar flow stream of fluid to give the effect of slicing the output stream perpendicularly to its longitudinal axis. The diverting means of the present invention is formed as a unitary assembly with a laminar output nozzle, and is disposed in a water tight tank coupled to the laminar flow nozzle. For diversion of the laminar flow stream, a continuous flow of water is controllably diverted by an electrically controlled solenoid valve into the path of the laminar flow stream. This diverting stream diverts the direction of the output flow so that it is captured within the tank and merely allowed to drain therefrom. By providing the diverter as an integrated assembly with the laminar flow nozzle, the diverter may be adjusted one time, and thereafter may be disassembled, reassembled, etc., without requiring further adjustment. Also the placement of the diverter with a tank allows the entire assembly to be located so that the laminar flow stream may appear to be projected from the surface of a pool.

9 Claims, 3 Drawing Sheets

APPARATUS AND METHOD FOR STREAM DIVERTER

This is a continuation of Ser. No. 096,315, filed 9/9/87, now abandoned which is a continuation of Ser. No. 800,223, filed 11/25/80, now abandoned.

FIELD OF THE INVENTION

This invention relates to the field of water displays, and to laminar flow nozzles and applications thereof.

BRIEF SUMMARY OF THE INVENTION

The present invention provides a means for generating and controllably terminating a laminar flow stream of fluid to give the effect of slicing the output stream perpendicularly to its longitudinal axis. The diverting means of the present invention is formed as a unitary assembly with a laminar output nozzle, and is disposed in a water tight tank coupled to the laminar flow nozzle. For diversion of the laminar flow stream, a continuous flow of water is controllably diverted by an electrically controlled solenoid valve into the path of the laminar flow stream. This diverting stream diverts the direction of the output flow so that it is captured within the tank and merely allowed to drain therefrom. By providing the diverter as an integrated assembly with the laminar flow nozzle, the diverter may be adjusted one time, and thereafter may be disassembled, reassembled, etc., without requiring further adjustment. Also the placement of the diverter with a tank allows the entire assembly to be located so that the laminar flow stream may appear to be projected from the surface of a pool.

DETAILED DESCRIPTION OF THE INVENTION

Figure 1:
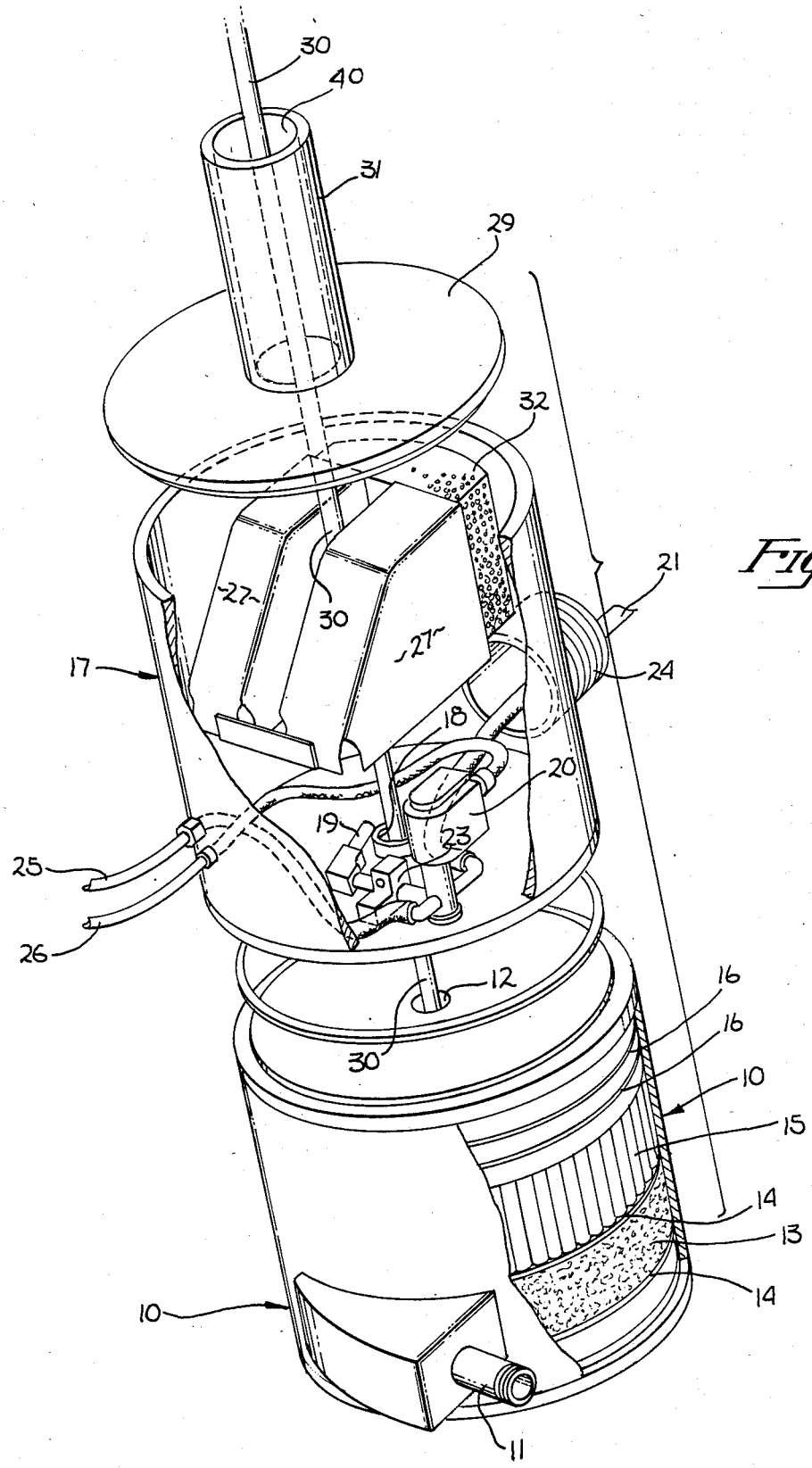
FIGS. 1 is a perspective view of the present invention, partially cut away.

A perspective view of the present invention is illustrated in FIG. 1. In the preferred embodiment, the present invention is comprised of a unitary assembly comprising a laminar flow nozzle subassembly, and a diverter subassembly coupled to the nozzle at position to allow controllable diversion of the laminar flow stream from the nozzle to create the illusion of instantaneously turning on and turning off the laminar flow stream. Since the laminar flow stream appears much like a solid glass or clear plastic rod, the ability to controllably and apparently instantly turn on and turn off the flow allows the generation of interesting water display effects, particularly when multiple assemblies are used and controlled in relation to each other to provide a moving snake-like water display.

The laminar flow nozzle, the lower assembly of FIG. 1, comprises a tank or enclosure 10 having a water inlet 11 adjacent the bottom thereof for injecting water into the tank in a substantially tangential manner, and ultimate discharge from the tank through orifice 12 at the center of the top thereof in the laminar flow stream 30.

The tank 10 in the preferred embodiment encloses a number of turbulence reducing means to substantially eliminate the turbulence in the flow of water therethrough, which absence of turbulence is maintained in the output stream of the laminar flow nozzle. In particular, the substantially tangential injection of water into the lower portion of the tank provides a substantial swirl in the lower chamber thereof, though at the same time injects the water in a manner which does not provide any substantial local vertical flow velocity thereof. As a consequence, while the injected water will tend to swirl as a single body of water in the bottom of tank 10, local eddies and other disturbances in the water will tend to die out rather quickly because of the viscus effects on those local disturbances.

The swirling water of course will be encouraged upward at a relatively slow rate as new water is injected, encountering a sheet of open cell foam 13, preferably a relatively rigid foam, supported in tank 10 by a metal screens 14 above and below the foam member. The foam defines a relatively large number of small circuitous flow paths, thereby breaking up the swirling water into very small streams therethrough. Because the foam presents a very high resistance to the continued swirling of the water in bulk, the swirling motion of the bulk water below the foam is broken up into very much weaker and very much smaller eddies in the cells of the foam, which eddies or rotational flow are quickly dissipated by viscous effects because of the relatively large ratio of cell surface area to volume of water therein. Further, the cell size, or perhaps more appropriately, the effective flow channel diameter for the flow paths through the opened celled foam, is very low, thereby assuring a low Reynolds number of the flow whereby the flow on the top surface of the foam layer will be substantially free of any components of rotation and of any turbulence, essentially coming through the top surface of the foam layer as relatively pure laminar flow.

Located above the foam layer 13 is a vertically oriented stack of small tubes 15 bonded together to provide relatively small flow paths therethrough and therebetween. Thus the flow through this assembly is also laminar, the assembly being of sufficient length so the flow is substantially fully developed by the time it reaches the top of the channels defined thereby, providing additional settling or stilling of any disturbances therein. Finally, mounted above assembly 15 are a pair of flow profile flattening screens 16, which screens have the effect of smoothing the relatively local velocity variation which resulted from the developed flow in each of the individual flow passage ways in the assembly 15. The net result is that the laminar flow stream 30 emitted from the top of the laminar flow nozzle assembly at a velocity dependent upon the rate at which water is injected into the inlet 11 is particularly free of disturbances and accordingly, has an appearance much like a solid glass or clear plastic rod.

Still referring to FIG. 1, a second tank 17 contains the diverter means, a gasket providing a water tight seal between the two tanks 10 and 17. Opening 18 in tank 17, larger in diameter than the laminar flow stream 30, is aligned with the orifice 12 of tank 10, with both openings being concentric to the respective tanks so that the output stream 30 has a continuous path through the diverter means and through the outlet opening 40 in top 29. Because the various openings are axially oriented and concentric to the outer diameters of the respective tanks, the diverter means in the upper tank can always be accurately located and referenced to the lower tank containing the laminar flow nozzle so that the two may be disassembled and reassembled as desired without requiring any readjustment of the diverter means, a time consuming and expensive process if always required as part of normal maintenance.

The principal components of the diverting means used for the present invention consists of spray nozzle 19, solenoid valve 20, water inlet 25 and inverted catch basin-like members 27 supported from the wall of tank 17 by vibration absorbing members 32. A continuous flow of water under pressure is provided through the inlet line 25 which continuously passes through the solenoid valve 20, the solenoid valve controlling the destination of that water flow. In particularly, normally the water flow will proceed through the valve and outward through outlet line 21 for recirculation. However, when the solenoid valve is actuated through power line 26, the flow will be diverted from the outlet line to the diverter nozzle 19.

Figure 2A:
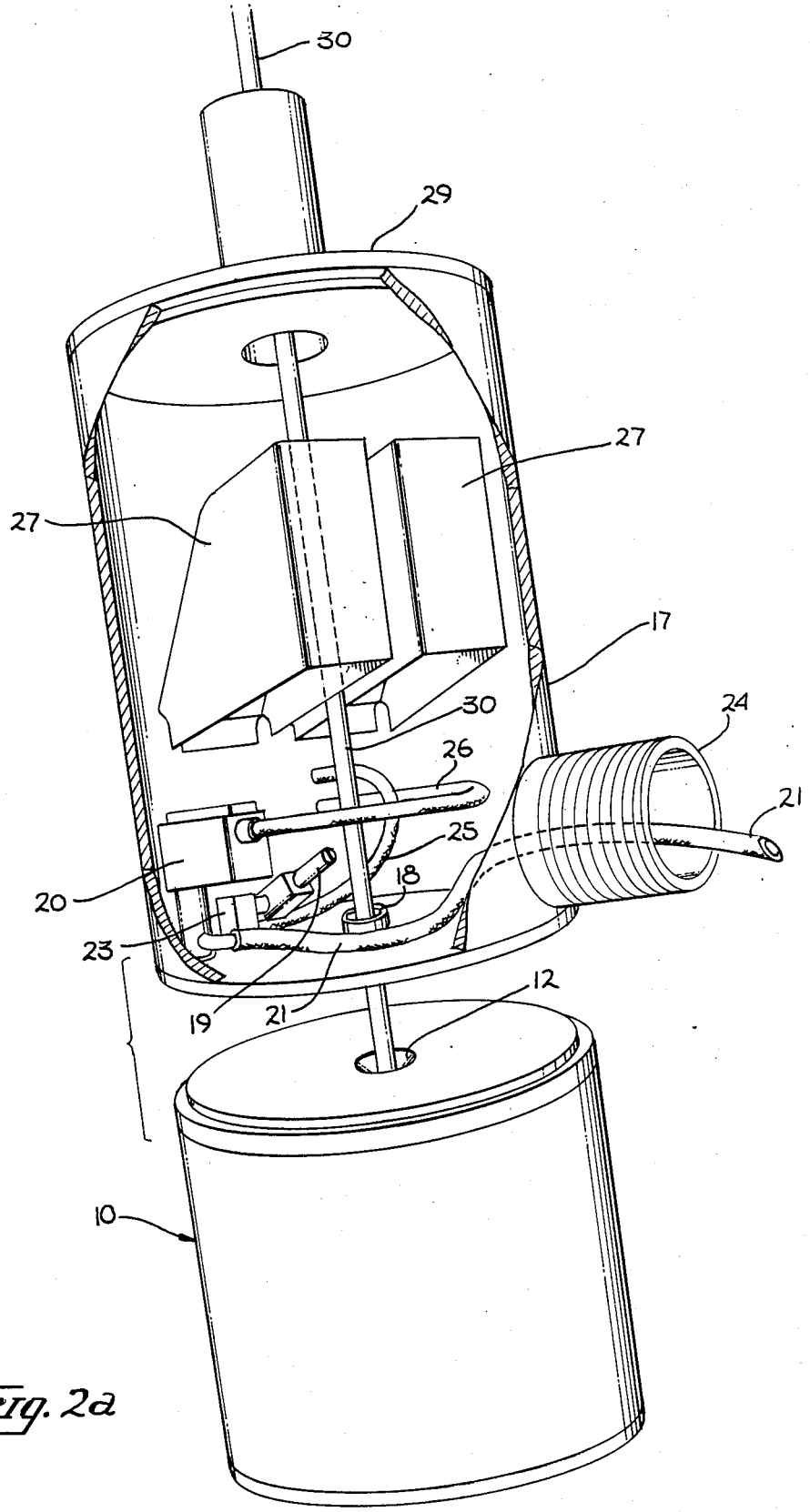
FIGS. 2A and 2B are schematic views of the invention illustrating the operation thereof.
Figure 2B:
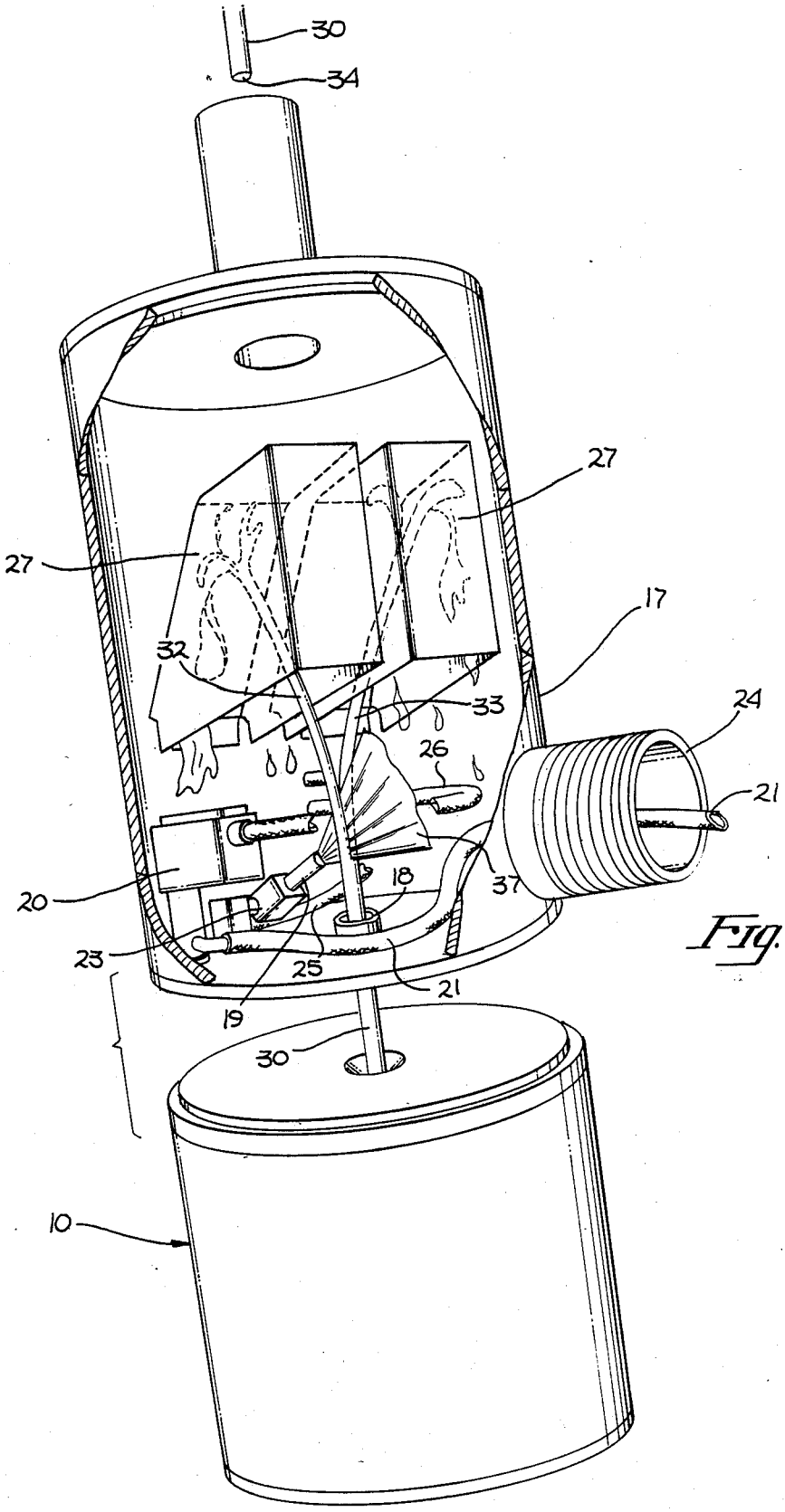

The operation of the system is best illustrated in FIGS. 2A and 2B. As may be seen in FIG. 2A, the diverter mechanism is inactive with the output stream passing through the opening 18 in the bottom of the diverter tank, between the catch basins 27 and on upward through the top of the assembly. Accordingly, the presence of the diverter mechanism when inactive has no affect on the laminar flow stream generated by the laminar flow nozzle therebelow. When the solenoid valve 20 is actuated, the control flow of water through line 25 is immediately directed to nozzle 19 which provides a strong shaped flow of water 37 much like a knife edge to slice the laminar flow stream 30 sufficiently positively to split the stream into two streams 32 and 33 and divert each half to one of the respective catch basins as illustrated in FIG. 2B. In this condition, none of the water, whether from the laminar flow stream or from the control stream, passes out of the top of the diverter tank, thereby allowing the substantially instantaneous stopping or cutting off of the water flow from the tank so that the end of the stream as cut off is relatively square and substantially free of any trailing drops as illustrated at 34 in FIG. 2B. The continuous flow of control water coupled with the three way valve as opposed to the mere use of a on/off solenoid valve has the advantage that it provides much faster control of the control water stream, as it effectively eliminates the affect of inertia for the water in the control line. Stated otherwise, if a simple on/off valve were used, the control water flow would have to be initiated on turning on the valve, and stopped upon turning off the valve, giving a much slower turn on than desired and a substantial water hammer on turn off. By having that control water constantly flowing, the solenoid valve can very quickly redirect the water as desired.

The catch basins 27 are positioned and shaped so that the diverted water will not fall back toward the laminar flow stream but instead will run downward to pass outward through drain line 24 at the lowermost position in the tank 17 for recycling. Accordingly, the control nozzle, control water stream and laminar flow stream always operate free of any interference from the water running off for recycling.

Several advantages are achieved by the specific structure of the present invention, achieved specifically by having the diverting means in its own self contained watertight tank. In particular, the diverting means is in general self aligning with the laminar flow stream 30 from the laminar nozzle, once the position of nozzle 19 is initially accurately adjusted. This is achieved by initially adjusting the position of the line or pipe feeding nozzle 19 as retained by clamp 23 fastened to the bottom of tank 17. Thus, once this adjustment is initially made, the tanks may be disassembled, etc., as may be required for maintenance purposes without requiring the readjustment of nozzle 19. Further, because the diverter when assembled on the laminar flow tank is sealed except for drain line 24 and the opening through the top of extension 31 in the top of the tank, the entire assembly may be placed under the surface 50 (FIGS. 2*a* and 2*b*) of a pool with only the top of extension 31 extending slightly above the top of the pool to create the appearance of the snake-like stream of water rising out of the pool like a sea serpent. Obviously in such an installation of course drain line 24 would not drain directly into the pool but rather, be coupled to a drain through the side or below the pool. In that regard, preferably extension 31, if not other components of the system, are fabricated from clear plastic thereby blending in with the water as much as possible. This arrangement of course is also highly suited for placement under rocks, etc., as the enclosed diverter will not be subject to interference by water from other sources, leaves, etc.

The present invention has been described herein with respect to a preferred embodiment thereof, though it will be understood by those skilled in the art that various changes in form and detail may be made therein without departing from the spirit and scope thereof.

We claim:

1. A water display device comprising:

a laminar flow nozzle for providing a laminar stream of water when connected to a source of water under pressure;

an enclosure having first and second openings substantially opposite one another, said enclosure coupled to and sealed with respect to said laminar flow nozzle such that said first and second openings are coincident with a laminar flow stream from said nozzle, said enclosure disposed below the surface of a body of water;

input means coupled to said enclosure for providing a continuously flowing diverting stream of water to said device;

nozzle means adjustably mounted within said enclosure relative to said first opening;

value means disposed in said enclosure between said input means and said nozzle means for directing said diverting stream to said nozzle means such that said nozzle means will produce an output stream intersecting a laminar flow stream from said laminar flow nozzle to divert the laminar flow stream from said second opening;

output means for removing the water from a diverting stream and a diverted laminar flow stream from said enclosure; and an extended hollow member coupled to and sealed to said enclosure such that said member is coincident with said second opening and said laminar flow stream, said member being a means for extending above the surface of said body of water, said extended hollow member providing an outlet for a laminar flow stream for display of said laminar flow stream without the laminar flow stream touching the extended hollow member.

2. The device of claim 1 further including a plurality of catch basins disposed within said enclosure, and catch basins disposed so as to receive said diverted laminar flow stream, said catch basins directing said diverted laminar flow stream away from said first and second openings.

3. The device of claim 1 wherein said extended member is comprised of a substantially transparent material.

4. The device of claim 1 wherein said enclosure comprises a cylindrical tank.

5. The device of claim 1 wherein said spray means comprises a spray nozzle emitting a fanlike output intercepting said output flow.

6. A method of diverting the laminar flow stream outputted by a laminar flow nozzle, said method comprising the steps of:

coupling and sealing to said nozzle an enclosure, said enclosure having first and second openings substantially opposite one another, said openings coincident with said laminar flow stream;

providing a continuously flowing diverting stream of water to said enclosure;

providing spray means in said enclosure, said spray means adjustably coupled to said enclosure relative to said first opening;

directing said diverting stream to said spray means, said spray means producing an output stream intercepting said laminar flow stream such that said flow stream is diverted from said second opening;

receiving said diverted laminar flow stream in a plurality of catch basins disposed in said enclosure;

removing said diverted flow stream and said diverting stream through drain means coupled to said enclosure;

disposing said enclosure beneath the surface of a body of water; and providing a path for said laminar flow stream through an extended member coupled to said enclosure for extending above the surface of said body of water, said laminar flow stream exiting said extended member for display of said laminar flow stream.

7. The method of claim 6 wherein said enclosure comprises a cylindrical tank.

8. The method of claim 6 wherein said spray means comprises a nozzle.

9. The method of claim 6 wherein said extended member comprises a substantially transparent material.

* * * * *